United States Patent [19]

Olinger et al.

[11] Patent Number: 4,557,406

[45] Date of Patent: Dec. 10, 1985

[54] STORAGE AND SHIPPING BIN

[75] Inventors: Dean E. Olinger, Clarkston; Robert A. Harding, Holly, both of Mich.

[73] Assignee: Clawson Tank Company, Clarkston, Mich.

[21] Appl. No.: 573,284

[22] Filed: Jan. 23, 1984

[51] Int. Cl.[4] ..... B65D 25/40

[52] U.S. Cl. ..... 222/564; 222/377; 220/DIG. 6

[58] Field of Search ..... 222/185, 377, 547, 564, 222/573, 328; 220/DIG. 6, 85 SP

[56] References Cited

U.S. PATENT DOCUMENTS

| | | | |
|---|---|---|---|
| D. 143,128 | 12/1945 | Butler | 220/DIG. 6 |
| 1,805,287 | 5/1931 | Krantz | 220/DIG. 6 |
| 3,407,971 | 10/1968 | Oehler | 222/185 |

FOREIGN PATENT DOCUMENTS

| | | | |
|---|---|---|---|
| 1536174 | 1/1970 | Fed. Rep. of Germany | 220/DIG. 6 |
| 1538651 | 7/1968 | France | 220/DIG. 6 |
| 599766 | 3/1948 | United Kingdom | 220/DIG. 6 |

*Primary Examiner*—H. Grant Skaggs
*Assistant Examiner*—Frederick R. Handren
*Attorney, Agent, or Firm*—Barnes, Kisselle, Raisch, Choate, Whittemore & Hulbert

[57] ABSTRACT

A bottom configuration for large liquid storage bins and drums which facilitates bottom draining and full recovery of contents including tributory passages leading to a central sump and a deeper clearing passage leading from the sump to a drain outlet.

1 Claim, 4 Drawing Figures

STORAGE AND SHIPPING BIN

FIELD OF INVENTION

Large storage and shipping drums for liquid or semi-liquid materials.

BACKGROUND AND OBJECTS OF INVENTION

Large bins and drums are used to ship and store commercial liquids such as oils, paints, chemical mixes and the like. The material may be removed by a top pump which draws from a pipe extending to a central sump, or by a bottom pump or by gravity drain from the bottom. In addition, the containers are used for different products such as different colored paints. The bins are too large to tip up so any material removal must be accomplished with the bins in stationary position.

It is an object of the present invention to provide a bottom construction which facilitates removal of the bin contents and also cleaning of the bins in a satisfactory manner.

Briefly, the invention comprises a bottom configuration which provides drainage tributories from corners of the bottom of the bin leading to a central sump. From this sump a deeper drain channel leads to a single corner and drain opening to draw off all liquid. The drain opening can be used for a gravity drain or a bottom pump draw off.

Other objects and features of the invention will be evident in the following description and claims in which the invention is disclosed together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
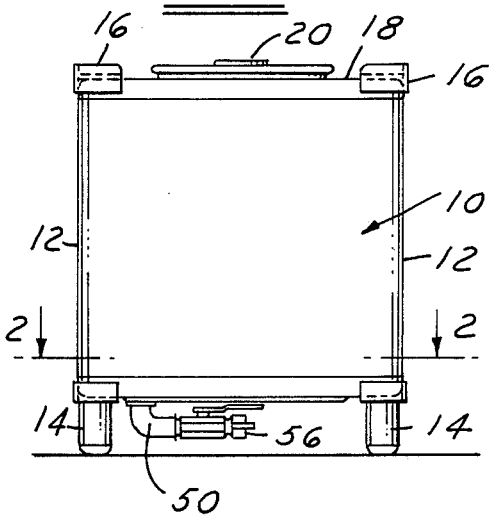
FIG. 1, an outside elevation of one side of a large container.

In FIG. 1, a cubical bin 10 is illustrated having side walls 12 and four supporting legs 14. At the corners of the top are socket brackets 16 to receive legs 14 when the bins are stacked vertically. The top 18 of bin 10 has a circular closure plate 20 which can support a top pump when desired.

The bins under consideration have, for example, side dimensions of 3½ feet and vertical dimensions of 3½ or 4 feet. Thus, they are large and must be moved by fork lift machines. It is desirable to have a flat bottom for facilitating the use of fork lift tracks but also to provide maximum storage capacity.

Figure 2:
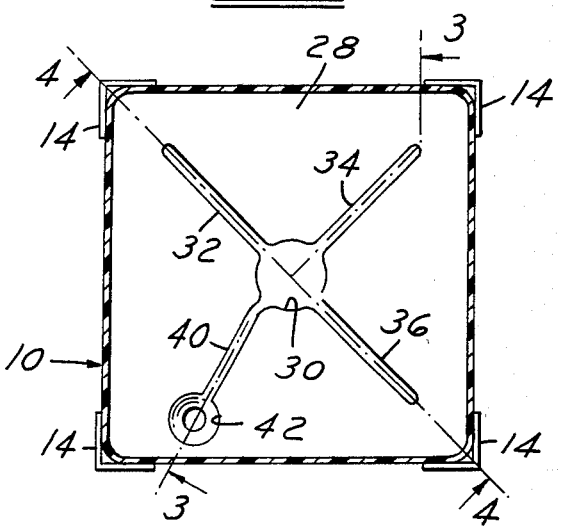
FIG. 2, a horizontal section on line 2—2 of FIG. 1.

The bottom of the bin is formed by a plate 28 viewed from the inside in the sectional view of FIG. 2. A small central sump is formed in the bottom plate 30 and radiating out from this sump are tributory channels 32, 34 and 36 reaching to three of the four corners of the bin. These channels increase in depth from the outer end to the central sump 30. A fourth drain channel 40 leads from the central sump 30 to the fourth corner drain opening 42. This channel 40 is deeper than channels 32, 34, 36. The three channels progress to a total depth of about ½" whereas the channel 40 will drop from the sump 30 to about ¾" at the drain 42 (FIG. 3).

Figure 3:
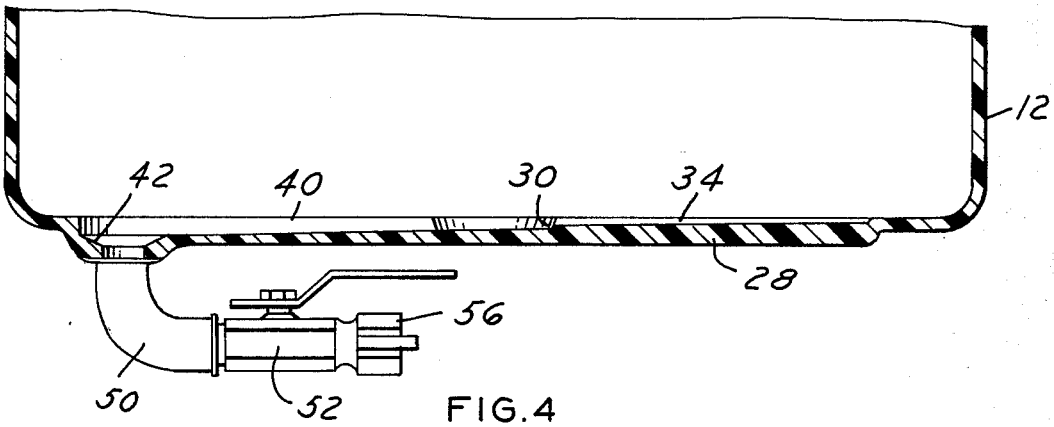
FIG. 3, a sectional view of the tank base on line 3—3 of FIG. 2.
Figure 4:
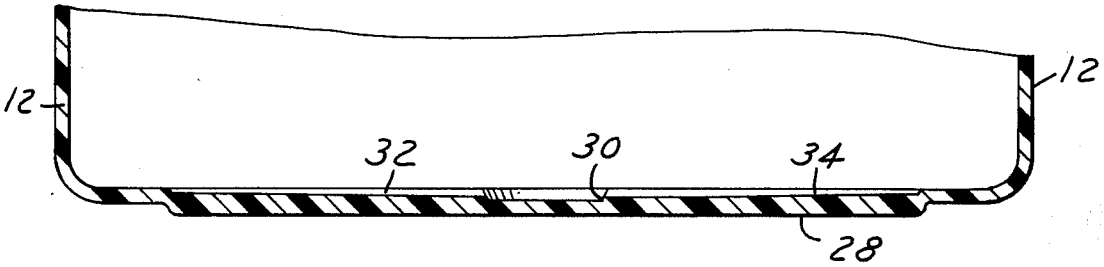
FIG. 4, a sectional view on line 4—4 of FIG. 2.

In the sectional view of FIG. 3, the channels are shown in cross-section. An elbow 50 is secured to the drain 42. This elbow can be connected to a bottom pump (not shown) or to a ball valve assembly 52 having an operating lever 54. A quick connect unit 56 is connected to the valve 52.

The channels 32, 34, 36 and 40 are formed into the bottom plate 28 by a forming die or by a machining operation depending on the manner in which the bin is constructed.

In the operation of the device, it will be seen that a top pump may be inserted through the top opening 20 with an inlet pipe extending into the central sump recess 30. In this manner of removing the contents, there will be complete removal except for a residual amount in channel 40. This can be drained out through opening 42. Similarly, when a bottom pump is connected to the elbow 50 the bin will be completely emptied. In each case a rinse or solvent directed into the tank will be flushed out through the radiating channels to insure a clean tank for reuse.

What I claim is:

1. In a large bulky container for liquid storage and shipping having a square cross-section with a bottom wall, side walls and a top closure, that improvement which comprises a relatively flat bottom wall having a depressed sump centrally of the bottom at an intersection of straight lines connecting opposite corners of the container, depressed channels on each of said intersecting lines extending from adjacent each corner to the central sump, three of said channels having bottom walls increasing in depth from the corner to the sump, the fourth channel increasing in depth from said sump to a drain opening adjacent one corner of the tank, wherein material may be pumped from said sump to empty the container except for a residual quantity which can be removed through said drain opening.

* * * * *